US006814849B2

(12) United States Patent
Lockwood et al.

(10) Patent No.: US 6,814,849 B2
(45) Date of Patent: Nov. 9, 2004

(54) LUMINESCENCE STABILIZATION OF ANODICALLY OXIDIZED POROUS SILICON LAYERS

(75) Inventors: David John Lockwood, Vanier (CA); Rabah Boukherroub, Ottawa (CA); Danial D. M. Wayner, Ottawa (CA); Nobuyoshi Koshida, Tokyo (JP)

(73) Assignee: National Research Council, Ottawa (CA)

( * ) Notice: Subject to any disclaimer, the term of this patent is extended or adjusted under 35 U.S.C. 154(b) by 188 days.

(21) Appl. No.: 10/012,943

(22) Filed: Dec. 10, 2001

(65) Prior Publication Data

US 2003/0106801 A1 Jun. 12, 2003

(51) Int. Cl.[7] ..... C25D 7/12

(52) U.S. Cl. ..... 205/157; 205/124; 205/198; 205/199; 205/220; 205/224

(58) Field of Search ..... 205/123, 124, 205/157, 198, 199, 220, 224

(56) References Cited

U.S. PATENT DOCUMENTS 6,288,390 B1 * 9/2001 Siuzdak et al. ..... 250/288
6,358,613 B1 * 3/2002 Buriak ..... 428/446

FOREIGN PATENT DOCUMENTS

JP 03198668 7/1991

OTHER PUBLICATIONS

"Visible electroluminescence from porous silicon", Nobuyoshi Koshida et al., Apply.Phys.Lett., vol. 60, No. 3, Jan. 20, 1992, pp. 347–349.

"Enhancement of the quantum efficiency and stability of electroluminescence from porous silicon by anodic passivation", B. Gelloz et al., Appl.Phys.Lett, vol. 73, No. 14, Oct. 5, 1998, pp. 2021–2023.

"Fourier transform IR monitoring of porous silicon passivation during post–treatments such as anodic oxidation and contact with organic solvents", M.A. Hory et al., Thin Solid Films, 255, 1995 pp. 200–203.

"Photoluminescence and electroluminescence from electrochemically oxidized porous silicon layers", F. Muller et al., Journal of Luminescence, 57, 1993, pp. 283–292.

"Surface passivation: a critical parameter for the visible luminescence of electrooxidised porous silicon", L. Mihalcescu et al., Journal of Luminescence, 57, 1993, pp. 111–115.

Ideal passivation of luminescent porous silicon by thermal, noncatalytic reaction with alkenes and aldehydes:, R. Boukherroub et al., Chem. Mater, vol. 13, No. 6, 2001, pp. 2002–2011.

"Stabilization of porous silicon electroluminescence by surface capping with silicon dioxide films", N. Koshida et al., Mat. Res. Soc. Symp. Proc., vol. 638, 2001, F18.3.1–F18.3.6.

(List continued on next page.)

*Primary Examiner*—Roy King
*Assistant Examiner*—William T. Leader
(74) *Attorney, Agent, or Firm*—Lawrence E. Laubscher, Jr.

(57) ABSTRACT

A porous silicon structure is stabilized by anodically oxidizing the structure and then subjecting it to chemical functionalization to protect non-oxidized surface regions, preferably in the presence of 1-decene under thermal conditions. This process creates a protective organic monolayer on the surface of the structure, rendering it highly stable.

15 Claims, 4 Drawing Sheets

OTHER PUBLICATIONS

"Electroluminescence with high and stable quantum efficiency and low threshold voltage from anodically oxidized thin porous silicon diode", Bernard Gelloz et al., Journal of Applied Physics, vol. 88, No. 7, Oct. 2000, pp. 4319–4324.

Enhancing efficiency and stability of porous silicon electroluminescence using electrochemical techniques:, B. Gelloz et al., Electrochemical Society Proceedings, vol. 99–22, pp. 27–34.

"Photoluminescence of high porosity and of electrochemically oxidized porous silicon layers", A. Bsiesy et al., Surface Society, 254, 1991, pp. 195–200.

Enhancing the external quantum efficiency of porous silicon leds beyond 1% by a post–anodization electrochemical oxidation, B.Gelloz et al., Mat.Res.Soc Symp–Proc., vol. 536, 1999, pp. 15–20.

* cited by examiner

LUMINESCENCE STABILIZATION OF ANODICALLY OXIDIZED POROUS SILICON LAYERS

BACKGROUND OF THE INVENTION

1. Field of the Invention

This invention relates to the field of optoelectronics, and in particular to a method of stabilizing porous silicon structures suitable for use in photoluminescent and electroluminescent applications.

2. Description of Related Art

Porous silicon (PSi) formed by chemical or electrochemical etching of crystalline silicon in HF-based solutions is of considerable interest in the optoelectronics field because of its ability to produce bright photoluminescence (PL) at room temperature. While the origin of the PL was uncertain, it is now believed that the PL results from the quantum confinement of carriers within the silicon nanocrystals composing the porous layer even though there are contributions from the surface species.

Due to the fabrication process used, freshly prepared PSi surfaces are covered with silicon-hydrogen bonds (Si—$H_x$). This termination offers good electronic properties to the surface. However, the Si—$H_x$ bonds are prone to hydrolysis when exposed to ambient air. A slow oxidation of the surface takes place and leads to the formation of surface defects, which are responsible for PL quenching and degradation of electronic properties of the material.

In any practical use of PSi layers for building optical devices, high PL and electroluminescence (EL) yields are required (external quantum efficiency (EQE)>1%). Typically, luminescent devices made from PSi are not stable and degrade with time due to oxidation of silicon-hydrogen bonds present on the surface. The luminescent intensity and electronic conduction properties diminish with time. There is therefore a need to stabilize such devices to prevent degradation of their properties over time. This can be achieved by passivation of the surface.

Thermal oxidation of the PSi surface is one of the most widely studied reactions to achieve a high PL stability, but this method destroys the porous layer integrity.

A. Bsiesy et al. *Surf. Sci.* 254, 195 (1991) have found that post-anodization of freshly prepared PSi layers in $KNO_3$ or $H_2SO_4$ followed by chemical dissolution in HF solutions can be used for thinning the PSi walls. They have also shown that partially oxidized porous layers exhibit a large increase in the PL and EL intensities. The electrochemical oxidation of PSi surfaces is a very convenient and cheap method and can easily be used for mass production. The rate of the oxidation can be readily controlled because the amount of the oxide formed on the surface is proportional to the exchanged charge.

Electrochemical anodization of the freshly prepared PSi surface is a method of passivation that retains the porous integrity of the layer. This approach has been successfully used for building electroluminescent devices with a high external efficiency (>1%). The electrochemical reaction requires hole consumption. Upon anodic polarization, a supply of holes from the substrate allows the electrochemical oxidation to occur at both the PSi walls and the bottom of the porous layer. Oxidation of the bottom part of the porous layer, however, breaks the electrical contact with the substrate and causes the end of the oxidation reaction. During this process, only the Si—Si back-bonds are oxidized and the Si—H bonds are not affected. This reaction leads to a surface that contains oxidized regions and non-oxidized ones. Even though growing an oxide film on the PSi layer offers a good surface passivation, PL quenching still occurs over time.

Recently, much effort has been devoted towards PSi passivation using chemical derivatization of the freshly prepared surfaces by replacing silicon-hydrogen (Si—$H_x$) bonds with Si—C or Si—O—C bonds, under various conditions, see, for example, J. M. Buriak, *J. Chem. Soc. Chem. Commun.* 1051 (1999); R. Boukherroub et al. *Chem. Mater.* 13, 2002 (2001). The organic modified PSi surfaces have shown good stability in different aqueous solutions of HF and KOH.

Such thermally or anodically oxidized products do not, however, fully satisfy the needs of industry, including high stability, the ability to retain the porous integrity of the material (no chemical etching during the thermal treatment), a low concentration of surface defects, the preservation of the PSi PL and EL, the possibility of controlling the wetting properties of the material by varying the nature of the end group, the availability of a wide range of functional groups compatible with the Si—$H_x$ bonds, the possibility of introducing several functional groups on the surface in one step by reacting the freshly prepared PSi surface with a mixture of organic molecules, and the spatial control of the distribution of molecules on the surface (patterning).

SUMMARY OF THE INVENTION

According to the present invention there is provided a method of stabilizing a luminescent porous silicon structure comprising passivating said porous silicon structure by subjecting said porous silicon structure to anodic oxidation to form a passivated structure, said anodic oxidation leaving residual exposed Si—$H_x$ bonds on said passivated structure in non-oxidized regions; and subsequently chemically modifying said passivated structure with an organic agent to consume at least some of said residual Si—$H_x$ bonds and thereby protect said non-oxidized regions.

The chemical modification preferably takes place in the presence of 1-decene or an analog, such as functional alkenes and aldehydes, and at a temperature of the order of 90 to 120° C. for about 1 to 24 hours, although the temperature and time can be varied. The EL stability is significantly improved by chemical modification even after short treatment of one hour. As the treatment time increases more, the stabilizing effect tends to saturate. Taking the associated reduction of the EL efficiency into account, the optimum chemical modification time exists in the range from 1 to 2 hours. Other suitable chemical reagents include alcohols, thiols, functional alkenes, and aldehydes. This step replaces the remaining silicon-hydrogen bonds, which are not oxidized during the electrochemical post anodization, with more stable silicon-carbon bonds.

Electrochemical oxidation of porous silicon (PSi) produces a surface that is not completely oxidized but in fact which is covered with native silicon-hydrogen (Si—$H_x$) bonds and regions with oxidized Si—Si back-bonds (OSi—$H_x$). These unprotected Si—$H_x$ bonds remaining between islands of oxidized silicon may oxidize slowly at room temperature when exposed to ambient air and thus introduce surface defects responsible for PL quenching. In accordance with the invention the anodically oxidized PSi layers are chemically modified, preferably using 1-decene under thermal conditions. The protected PSi layers have much greater stability than oxidized layers that have not been subjected to the chemical functionalization treatment.

The invention also provides an optoelectronic device or sensor comprising a porous silicon structure stabilized with an anodically oxidized surface protected by an organic layer attached to the surface. The organic layer is preferably in the form of an organic monolayer that can be a mixture of different organic molecules. It can also be a mixture of saturated and conducting molecules forming molecular wires.

BRIEF DESCRIPTION OF THE DRAWINGS

The invention will now be described in more detail, by way of example only, with reference to the accompanying drawings, in which.

DETAILED DESCRIPTION OF THE PREFERRED EMBODIMENTS

Figure 7:
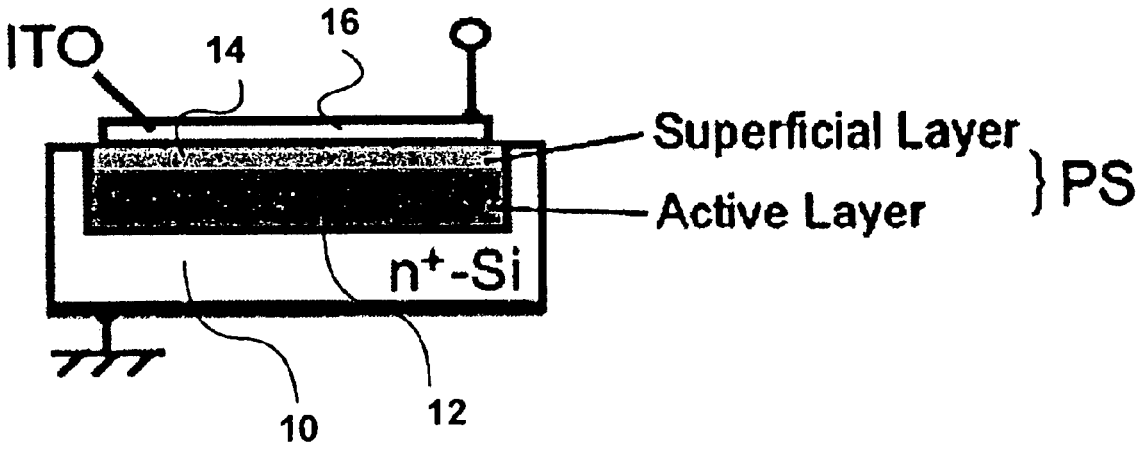
FIG. 7 shows a structure in accordance with the invention.

The structure shown in FIG. 7 comprises a substrate 10 in which is formed an active layer 12 and superficial layer 14 of porous silicon. An ITO contact layer 16 is deposited on the superficial layer 14. The active layer 12 serves as a light emitting layer.

EXAMPLE 1

In order to demonstrate the principles of the invention PSi layers were formed on Si(100) Boron p-type (1.48–1.84 ohm-cm) silicon wafers by electrochemical etching in HF/EtOH=1/1 for 8 min at a current density of 5 mA/cm$^2$. The porosity was estimated to be 70% by an X-ray reflectivity technique and the porous layer thickness was about 2 $\mu$m (determined by cross-sectional SEM). After rinsing with ethanol, the freshly prepared PSi sample was anodically oxidized in 1M $H_2SO_4$ for 5 minutes at different current densities (1, 3, and 5 mA/cm$^2$), rinsed with ethanol and dried under a stream of dry nitrogen.

The chemical modification of the PSi layers was achieved by immersing the freshly anodized sample in a deoxygenated solution of 1-decene and heating the solution for 24 hours at 120° C. The modified sample was then rinsed with heptane and 1,1,1-trichloroethane to remove the unreacted 1-decene.

Transmission infrared Fourier transform (FT-IR) spectra were recorded using a Nicolet MAGNA-IR 860 spectrometer at 2 cm$^{-1}$ resolution. The samples were mounted in a purged sample chamber. Background spectra were obtained using a flat untreated H—Si(100) wafer. Photoluminescence and Raman measurements were performed at room temperature in a quasi-backscattering geometry using 30 mW of $Ar^+$ laser excitation at 457.9 nm under a helium gas atmosphere. The detector was a cooled RCA 31034A photomultiplier.

Figure 1A:
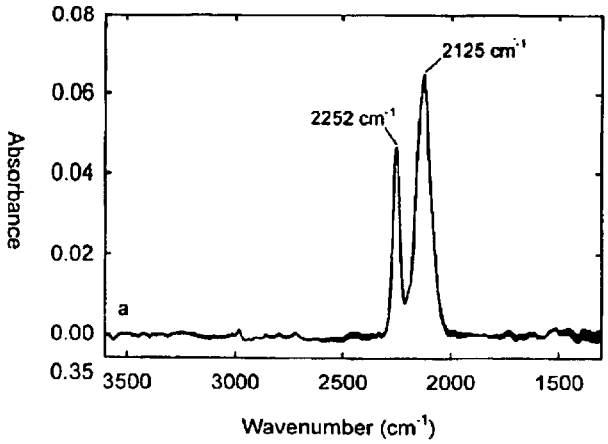
FIGS. 1*a* and 1*b* show the transmission infrared Fourier-transform spectra of freshly prepared and anodized PSi in 1M $H_2SO_4$ for 5 min at 3 mA/cm$^2$a) before derivatization and b) after chemical modification with 1-decene.

FIG. 1*a* displays the IR spectrum of a freshly prepared sample after anodic oxidation in 1M $H_2SO_4$ for 5 min at 3 mA/cm$^2$. Two types of Si—$H_x$ vibrations can be observed: $(Si)_{3-x}Si—H_{x+1}$ centered at 2125 cm$^{-1}$ and $(Si—O)_{3-x}Si—H_{x+1}$ (x=0–2) centered at 2252 cm$^{-1}$.

Figure 1B:
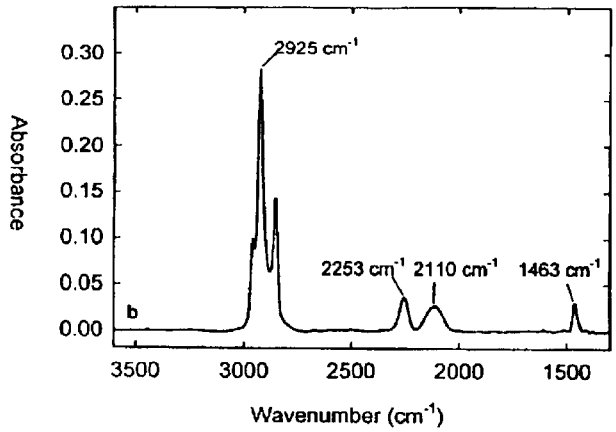

The frequency shift of the second peak from 2125 cm$^{-1}$ to 2252 cm$^{-1}$ is caused by the oxidation of the Si—Si back-bonds. The PSi samples oxidized for 5 min at current densities of 1 or 5 mA/cm$^2$ showed different degrees of oxidation. The first sample exhibited a very small peak at 2252 cm$^{-1}$ while the latter showed an intense peak. After reaction with 1-decene at 120° C. for 24 hours, new peaks due to the C—H vibrations and methylene bending modes of the alkyl chain at 2925 and 1463 cm$^{-1}$ appear as shown in FIG. 1*b*. The absence of the C═C double bond stretching at 1640 cm$^{-1}$ and the decrease of the Si—H intensity is in agreement with a covalent attachment (not physi-absorption) of the organic molecules to the surface through Si—C bonds.

The chemical process takes place with Si—H consumption. Surprisingly, the hydrosilylation reaction consumes mainly the non-oxidized Si—$H_x$ rather than the oxidized ones. The Si—$H_x$ intensity decreases substantially while the intensity of the oxidized Si—$H_x$ remains almost unchanged. This difference in the reactivity of the Si—H bonds may be attributed to the lower reactivity of siloxane versus silane molecules or to the mechanism by which this reaction occurs.

When the surfaces (oxidized for 3 or 5 min at 3 mA/cm$^2$) modified with 1-decene were boiled in $CCl_4$ and in ultra-pure water for one hour, there was no change in the Si—$H_x$ IR intensity. This result shows the high stability of the modified surfaces.

Figure 2:
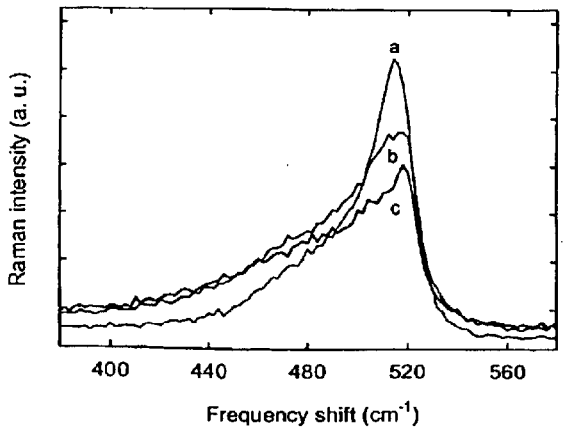
FIG. 2 shows Raman spectra (Si peak) of the PSi surfaces anodized in 1M $H_2SO_4$ for 5 min at different current densities: a) 1, b) 3, and c) 5 mA/cm$^2$ after modification with 1-decene.

Raman spectroscopy can be used to determine the average nanoparticle diameter. The silicon optical phonon line shifts to lower frequency (see FIG. 2, traces a–c) with decreasing nanocrystal size and broadens asymmetrically. From the frequencies of the Raman peaks in FIG. 2, the average spherical nanoparticle diameter is estimated to be 4.0, 3.7, 3.3 nm for derivatized samples oxidized for 5 min at 1, 3, and 5 mA/cm$^2$, respectively. Non-derivatized, but oxidized, PSi samples gave similar results, showing that the porosity is unaffected by derivatization. The results agree with the expectation that the size of the silicon nanoparticles composing the porous layer decreases with increasing electrochemical oxidation. For the anodically oxidized PSi sample at 5 mA/cm$^2$ for 5 min, a sharp peak at 520 cm$^{-1}$ is apparent (trace c). This is due to the underlying crystalline silicon substrate.

Figure 3:
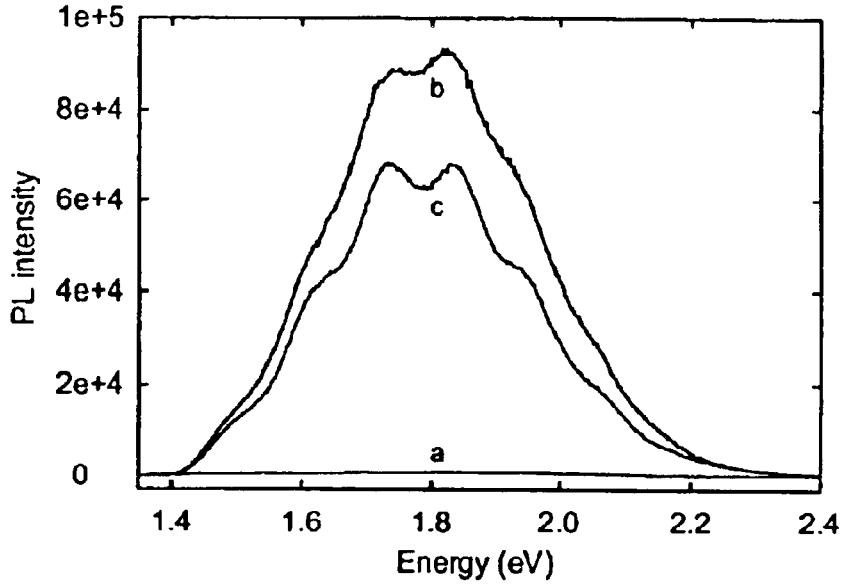
FIG. 3 shows the photoluminescence spectrum of the PSi surface etched at 5 mA/cm$^2$ in HF/EtOH=1/1 for 8 min a) before electrochemical anodization, and anodized in 1M $H_2SO_4$ at 3 mA/cm$^2$ for 5 min b) before derivatization and c) after chemical modification with 1-decene.

FIG. 3 (trace a) shows the PL of a freshly prepared PSi sample without any further oxidation in 1M $H_2SO_4$. It is centered at 1.8 eV and characteristic of 70% porosity. When the sample was anodically oxidized at 3 mA/cm$^2$ for 5 min, an increase of the PL intensity by a factor of 100 was observed (trace b). The PL intensity is centered at 1.8 eV (similar to the non-oxidized PSi sample).

This large increase of the PL intensity is assigned to an improvement of the barrier efficiency towards the nonradiative leaks. After reaction with 1-decene at 120° C. for 24 h, the PL intensity decreases by 25% (trace c). A similar effect was observed during the thermal modification with 1-decene of freshly prepared PSi samples that were not subjected to further electrochemical oxidation in sulfuric acid. When the surface was anodically oxidized at the same current density (3 mA/cm$^2$) for 3 min, the PL intensity was not as bright as the one observed for the sample etched for 5 min. A similar but weaker effect was observed for the PSi sample anodized at 1 mA/cm$^2$ for 5 min in 1M $H_2SO_4$. Only an increase by a factor of 1.6 of the original PL intensity (before anodization) was obtained. This insignificant increase may be attributed to the presence of small amounts of oxygen in the silicon back-bonds and incomplete oxidation of the narrower regions of the silicon nanocrystal.

Figure 4:
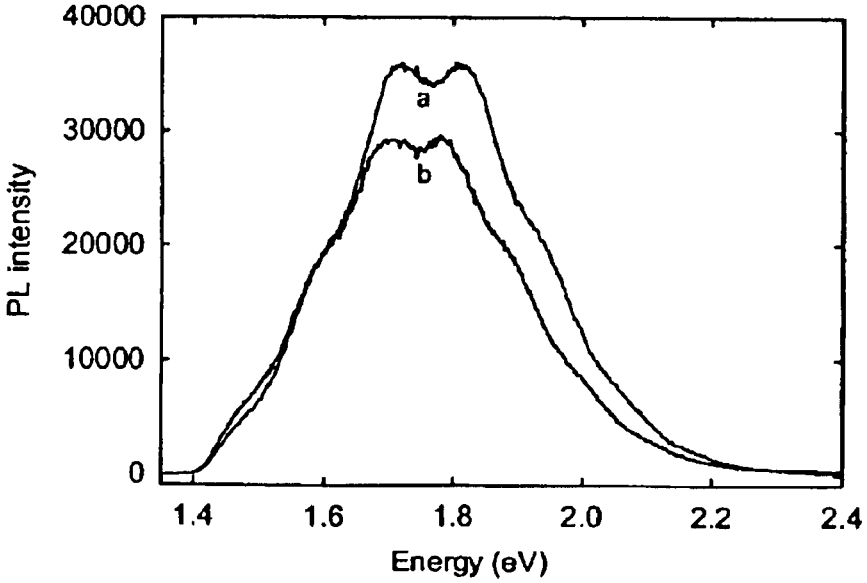
FIG. 4 shows the photoluminescence spectrum of the PSi surface etched at 5 mA/cm$^2$ in HF/EtOH=1/1 for 8 min and anodized in 1M $H_2SO_4$ at 5 mA/cm$^2$ for 5 min a) before derivatization and b) after chemical modification with 1-decene.

FIG. 4 (trace a) exhibits the PL intensity of the PSi sample etched in HF/EtOH=1/1 for 8 min at 5 mA/cm$^2$ and then oxidized in 1M $H_2SO_4$ for 5 min at 5 mA/cm$^2$. The photoluminescence intensity was increased by a factor of 38. It was again centered at 1.8 eV. The PL intensity was reduced, in this case, by 22% after the chemical process (trace b).

EXAMPLE 2

A substrate in the form of an n$^+$-Si (111) wafer with a resistivity of 0.018 Ωcm was cleaned in a solution of $HNO_3$:HF:$CH_3CO_2H$ in the ratio 1:1:1 for five minutes.

A superficial layer (200 nm thick) was then formed on the surface of the substrate by anodization in the dark in the presence of a solution of 10% of hydrofluoric acid at a current of 5 mA/cm$^2$ for 30 s. Next an active layer (800 nm thick) was formed in the presence of a 40% solution of hydrofluoric acid (at 0° C.) at a current density of 3 mA/cm$^2$ for 10 min under illumination at 1 W/cm$^2$ with a tungsten lamp.

An electrochemical oxidation was then carried out with 1M $H_2SO_4$ at a current density of 3 mA/cm$^2$ for 3 min.

Next chemical modification of the surface was carried out with 1-decene [$CH_3(CH_2)_7CH$: $CH_2$] at 90° C. for one hour.

Finally a top contact was formed by depositing an ITO film (300 nm thick) by rf-sputtering.

Figure 5:
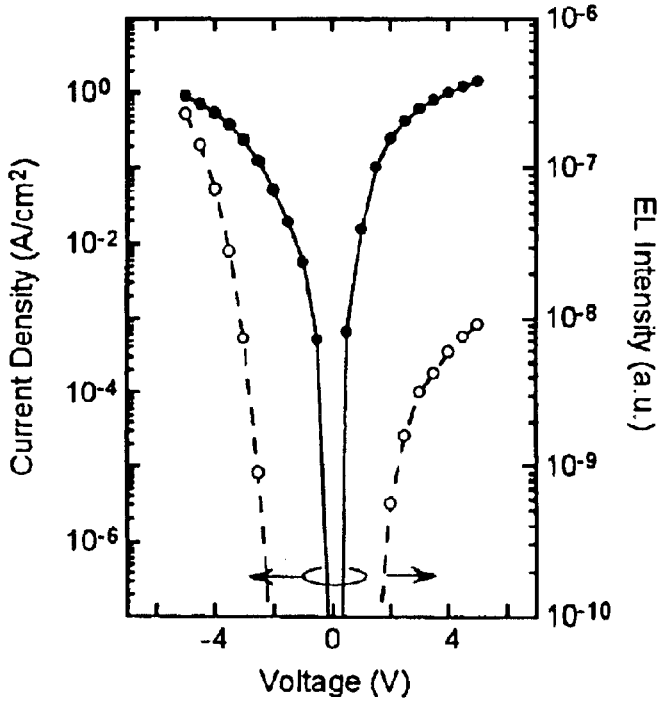
FIG. 5 shows the current-voltage characteristics (solid curve) of a fabricated PSi diode and the corresponding EL characteristics (dashed curve)

FIG. 5 shows the current density and EL characteristics of a device fabricated in accordance with the above method. The improvement in EL intensity of about two orders of magnitude in the reverse bias direction is highly significant.

Figure 6:
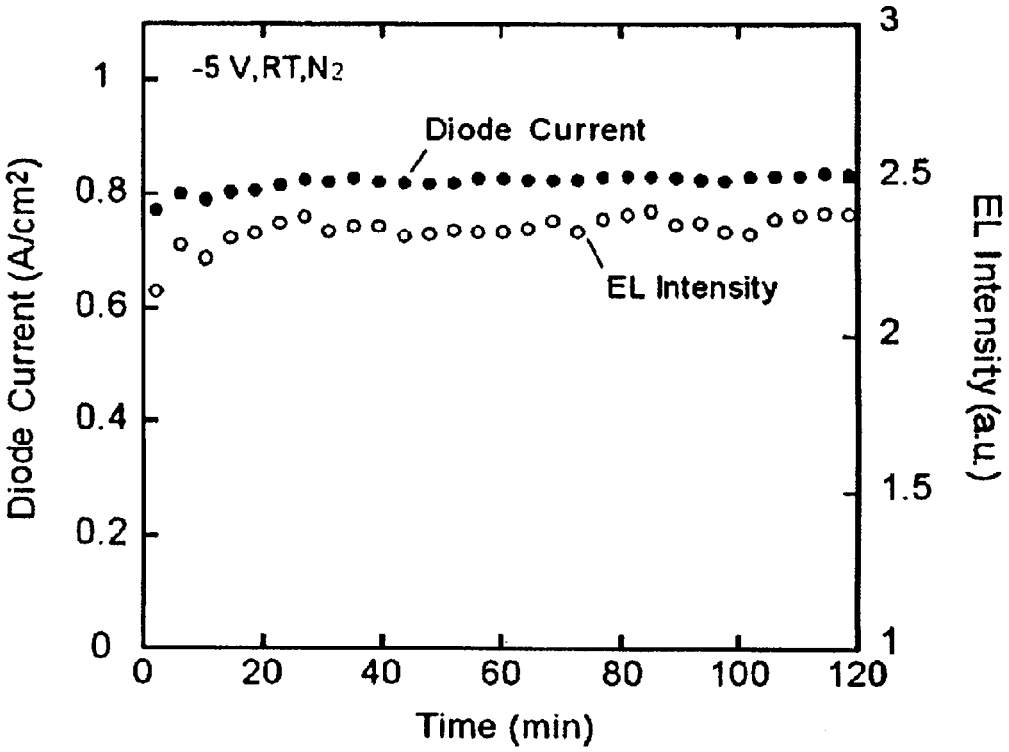
FIG. 6 shows the time evolution of the diode current and the EL intensity of a fabricated PSi device under continuous operation for 2 h at a bias voltage of 5 V.

FIG. 6 shows that the EL intensity of such a device is highly stable with time up to two hours. Typically a prior art device would show an initial rapid variation in EL intensity and then stabilize at a low value after about 20 minutes. An example of such a device is described in B. Gelloz and N. Koshida, J. Appl. Phys. 88, 4319 (2000), the contents of which are herein incorporate by reference. The chemical modification of the surface dramatically improves the EL intensity behavior with time. In contrast to the untreated device, in which the EL efficiency rapidly degrades within 10–20 min, the present EL efficiency shows no signs of degradation under continuous operation for a few hours. It is clear that current-induced oxidation followed by the formation of surface defects is successfully suppressed by surface passivation employing stable Si—C bonding.

The use of anodic oxidation of the porous layer improves the PL efficiency and retains the porous integrity of the sample. This chemical treatment consumes preferentially the non-oxidized Si—$H_x$ bonds and thus produces a surface that is composed of separate oxidized and alkylated regions. The chemical reaction does not consume totally the non-oxidized Si—$H_x$, because of the steric hindrance at the surface. However, the density of the molecules on the surface is high enough to protect the remained Si—H bonds against oxidation when the modified surfaces are boiled in $CCl_4$ and water. This thermal modification process is very easy to carry out and renders optical devices stable without affecting their electrical performance. It also allows the introduction of functional groups on the surface and thus opens new opportunities in the field of optoelectronics and sensors.

Although the invention has been described and illustrated in detail, it is clearly understood that the same is by way of illustration and example only and is not to be taken by way of limitation, the spirit and scope of the present invention being limited only by the terms of the appended claims.

We claim:

1. A method of stabilizing a luminescent porous silicon structure comprising:

a) passivating said porous silicon structure by subjecting said porous silicon structure to anodic oxidation to form a passivated structure, said anodic oxidation leaving residual exposed Si—$H_x$ bonds on said passivated structure in non-oxidized regions; and b) subsequently chemically modifying said passivated structure with an organic agent to consume at least some of said residual Si—$H_x$ bonds and thereby protect said non-oxidized regions.

2. A method as claimed in claim 1, wherein said step of chemically modifying said passivated structure is carried out under thermal conditions.

3. A method as claimed in claim 2, wherein said step of chemically modifying said passivated structure is carried out at a temperature of about 90 to 120° C. over a period of about 1 to 24 hours.

4. A method as claimed in claim 1, wherein during said step of chemically modifying said passivated structure, said residual Si—$H_x$ bonds are replaced with Si—C bonds.

5. A method as claimed in claim 1, wherein said organic agent is a compound selected from the group consisting of: alkenes, functional alkenes and aldehydes.

6. A method as claimed in claim 1, wherein said organic agent forms an organic monolayer on said structure.

7. A method as claimed in claim 6, wherein said organic monolayer is attached to said surface through Si—C bonds.

8. A method as claimed in claim 1, wherein said organic agent is 1-decene.

9. A method as claimed in claim 1, wherein said organic agent is selected from the group consisting of: functional alkenes and aldehydes.

10. A method as claimed in claim 1, wherein said structure is anodically oxidized in $H_2SO_4$.

11. A method as claimed in claim 10, wherein porous silicon structure is anodized in about 1M sulfuric acid ($H_2SO_4$) at about 3 mA/cm$^2$ for about 5 min.

12. A method as claimed in claim 1, wherein said organic agent is selected from the group consisting of: alcohols, thiols, functional alkenes, and aldehydes.

13. A method of stabilizing a luminescent porous silicon structure comprising:

a) passivating said porous silicon structure by subjecting said structure to anodic oxidation to form a passivated structure, said anodic oxidation leaving residual exposed Si—$H_x$ bonds on said passivated structure in non-oxidized regions; and b) subsequently chemically modifying said passivated structure under thermal conditions in the presence of 1-decene or an analog to consume at least some of said residual Si—$H_x$ bonds and thereby protect said non-oxidized regions.

14. A method as claimed in claim 13, wherein said thermal treatment is carried out for about 1 to 24 hours at about 90 to 120° C.

15. A method as claimed in claim 13, wherein said anodic oxidation takes place in about 1M sulfuric acid ($H_2SO_4$) at about 3 mA/$cm^2$ for about 5 min.

* * * * *